US005138965A

United States Patent [19]

Culp

[11] Patent Number: 5,138,965

[45] Date of Patent: Aug. 18, 1992

[54] WATER LEVEL COMPENSATION DEVICE

[76] Inventor: David W. Culp, 5875 Mallview Ct., Columbus, Ohio 43231

[21] Appl. No.: 548,495

[22] Filed: Jul. 2, 1990

Related U.S. Application Data

[63] Continuation-in-part of Ser. No. 439,182, Feb. 8, 1990, abandoned.

[51] Int. Cl.[5] ..... B63B 21/00

[52] U.S. Cl. ..... 114/230; 114/219; 114/263; 405/219

[58] Field of Search ..... 114/230, 263, 219; 405/219

[56] References Cited

U.S. PATENT DOCUMENTS

| | | | |
|---|---|---|---|
| 2,808,016 | 10/1957 | Jarnot | 114/230 |
| 2,873,712 | 2/1959 | Gossen | 114/230 |
| 2,979,014 | 4/1961 | Yordi | 114/230 |
| 2,990,803 | 7/1961 | Henderson | 114/230 |
| 3,019,759 | 2/1962 | woods | 114/230 |
| 3,088,287 | 5/1963 | Berry | 114/263 X |
| 4,697,538 | 10/1987 | Day | 114/230 |

*Primary Examiner*—Sherman Basinger
*Attorney, Agent, or Firm*—Frijouf, Rust & Pyle

[57] ABSTRACT

An improved water level compensation device is disclosed for adjusting the vertical position of a floating object relative to a fixed land mass. A first channel having a slot is attached to the fixed land mass in a substantially vertical position. A carriage is movably retained within the first channel for enabling bidirectional vertical movement therein. A mounting plate external to the first channel is affixed to the carriage through the slot in the first channel. A second channel is secured relative to the land mass for movably retaining a counterweight. A flexible cable interconnects the counterweight and the carriage. A coupler is affixed to the mounting plate for releasably coupling the floating object relative to the fixed land mass irrespective of variations in the vertical position of the floating object due to variations in water level.

13 Claims, 8 Drawing Sheets

WATER LEVEL COMPENSATION DEVICE

CROSS REFERENCE TO RELATED APPLICATIONS

This is a continuation-in-part of application Ser. No. 439,182 filed Feb. 8, 1990 and now abandoned. All subject matter set forth in application Ser. No. 439,182 filed Nov. 20, 1989 is incorporated by reference into the present application.

BACKGROUND OF THE INVENTION

1. Field Of The Invention

This invention relates to marine docks and docking systems and more particularly to marine docks and docking systems used in geographical areas with expected variations in water level. More specifically, the present invention relates to an improved water level compensation device which automatically adjusts the vertical position of a floating object relative to a fixed land mass.

2. Information Disclosure Statement

The problems associated with docks and docking systems used in geographical areas with expected variations in water level are well known to those skilled in the art. These adverse effects are not limited solely to tidal bodies of water as might be expected, but extends to inland waters such as lakes, reservoirs and rivers. These inland waters are influenced by seasonal factors, rainfall, and man made controls. The difference between tidal effects and those of inland waters are that tidal differences occur at a significantly greater frequency than inland water level changes Extreme water level changes exceeding 20 feet are possible, but generally the average change is substantially less.

These differences have always presented difficulties for small craft operators. Many dissertations have been presented attempting to teach the art of docking a small craft, but ultimately the process becomes one of trial and error in which vessel damage may be the result.

Dock lines normally used include bow and stern lines and one or more spring lines as should be well known to those skilled in the art. In order to allow for rise and fall in water level, all lines must be set as slack as possible, thus allowing the vessel to move on a horizontal plane as well as vertically. It is this horizontal vessel movement that causes damage to the vessel and possibly the dock.

A multitude of fender devices have been developed in an effort to eliminate vessel or dock damage. These devices have only met with limited success, since their placement relative to the vessel and the dock are critical, and these devices only mask the effects of the problem of horizontal movement.

Devices designed to minimize the horizontal movement of a docked vessel while allowing vertical movement to compensate for water level changes include dock line snubbing devices and mooring whips. The snubbing devices are manufactured from materials with high elasticity and are installed in parallel with the dock lines. The elastic action of the snubbing device is intended to maintain control over the horizontal movement of the docked vessel Mooring whips are devices wherein a tubular whiplike element is affixed to the dock at a proximal end with a distal end of the tubular element extending out over the water. A line extends from the distal end of the tubular whiplike element to be secured to a cleat or other mooring device on the vessel As the water level decreases, the mooring whips bend to accommodate the vessel movement, and as the water level increases, the mooring whips return to a substantially straight position. Mooring whips have met with only limited success since mooring whip are inherently designed to be used only over a rather narrow range of water level differences.

Floating docks have proved to be one of the most effective methods to address the problem of compensating for water variation. Since the dock structure moves vertically with the rise and fall of the water level, a vessel may be tied to the floating dock structure with dock lines adjusted to minimize the horizontal movement of the vessel. A major problem associated with a floating dock structure is the relative instability when loaded with a weight, such as the weight of a person or the like. This problem has been addressed by constructing larger, heavier floating docks, as well as more advanced anchoring systems. In addition to greatly increasing the cost of a floating dock system, the additional surface area needed reduces the total number of docks possible within a given area. Existing marinas, built for older narrow beam vessels are attempting to provide docks for newer wide beam vessels, consequently every effort must be employed to minimize the encroachment of water surface area by docking systems.

Docks and docking systems have traditionally neglected the issue of unauthorized vessel use. An increase in vessel theft is directing a new awareness towards this problem, but thus far no reasonable solutions have been described to this problem.

Therefore, it is an object of the present invention to provide an improved water level compensation device which overcomes the problems experienced by the prior art during the manufacture and use of marine docks and docking systems used in geographical areas with expected variations in water level.

Another object of this invention is to provide an improved water level compensation device which permits automatic control over wide ranges of vertical position of a floating object while maintaining substantial horizontal control over the floating object.

Another object of this invention is to provide an improved water level compensation device which provides a docking system for a small craft.

Another object of this invention is to provide an improved water level compensation device which provides a docking system for a small craft wherein the small craft may be locked to the docking system to prevent unauthorized vessel usage.

Another object of this invention is to provide an improved water level compensation device which provides a docking system for a small craft wherein a fending system is provided to nondestructively absorb the impact of the small craft.

Another object of this invention is to provide an improved water level compensation device for adjusting the vertical position of a floating dock structure relative to a fixed land mass and for simultaneously maintaining the floating dock structure parallel to the surface of the body of water.

Another object of this invention is to provide an improved water level compensation device which may be installed on existing small crafts and existing floating docks.

Another object of this invention is to provide an improved water level compensation device which may be installed on existing small crafts and existing floating docks without specialized tools or specialized skilled.

Another object of this invention is to provide an improved water level compensation device which is reliable and low cost.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with a specific embodiment shown in the attached drawings. For the purpose of summarizing the invention, the invention relates to an improved apparatus and method for a water level compensation device. A first channel means having a top end and a bottom end with a slot extending proximate the top end to the bottom end is provided with a means for attachment to the fixed land mass in a substantially vertical position. A carriage means is movably retained within the first channel means for bidirectional movement in a substantially vertical direction between the top end to the bottom end of the first channel means. A mounting plate, disposed external to the first channel means, is affixed to the carriage means through the slot in the first channel means. A second channel means, having a top end and a bottom end, is provided with a means for attachment to the fixed land mass in a substantially vertical position. A counterweight is movably retained within the second channel means for bidirectional movement in a substantially vertical direction between the top end and the bottom end of the second channel means. A flexible cable having a first end affixed to the carriage means and a second end affixed to the counterweight is journalled by a pulley rotatably mounted proximate the top end of the first and second channel means enabling the counterweight to balance the weight of the carriage means, the mounting plate, and a coupling means which is affixed to the mounting plate for releasably coupling the carriage means to the floating object for securing the floating object relative to the fixed land mass irrespective of variations in the vertical position of the floating object due to variations in water level.

In a more specific embodiment of the present invention, the improved water level compensation device is provided with a coupling means comprising a SAE trailer coupler and a trailer ball. The SAE trailer coupler is affixed to the carriage means, and the trailer ball is affixed to the floating object for providing a rapidly releasable coupling between the floating object and the fixed land mass. A locking means may be provided for locking the SAE trailer coupler to trailer ball affixed to the floating object.

In one embodiment of the invention, the invention is incorporated into an improved water level compensation device wherein the first channel means comprises a substantially rectangular tubular member having a back surface, a front surface, a first side, and a second side, and the slot disposed in the front surface of the substantially rectangular tubular member.

In another embodiment of the invention, the improved water level compensation device is provided with a first channel means comprising a substantially rectangular tubular member having a back surface, a front surface, a first side, and a second side, and a second channel means comprising a tubular member constructed from a flexible and resilient material having a back surface and a front surface. The front surface of the second channel means extends outwardly from the fixed land mass a substantially greater distance than the front surface of the first channel means to enable the second channel means to act as a fender means for non-destructively absorbing impact of the floating object.

In another embodiment of the present invention, the improved water level compensation device is use with a small craft. In another embodiment of the present invention, the improved water level compensation device is used with a floating dock.

In a specific embodiment of the invention, carriage means includes a plurality of wheels secured to the carriage means for engaging the back surface and the front surface of the first channel means to retain the carriage means within the first channel means and for enabling the bidirectional movement of the carriage means within the first channel means. The carriage means includes a first axle secured to a first end of the carriage means and a second axle secured to a second end of the carriage means. A first and second plurality of wheels are secured to the first and second axles for engaging the back surface and the front surface of the first channel means to retain the carrier means within the first channel means and for enabling the bidirectional movement of the carriage means within the first channel means.

In one embodiment of the invention, the invention is incorporated into an improved water level compensation device for adjusting the vertical position of a floating dock structure relative to a fixed land mass. In this embodiment, an upper and a lower carriage means are movably retained within the first channel means for bidirectional movement in a substantially vertical direction. The lower carriage means is connected to the upper carriage means with the lower carriage means being disposed within the first channel means below the upper carriage means. An upper mounting plate disposed external to the first channel means is affixed to the upper carriage means through the slot in the first channel means and a lower mounting plate disposed external to the first channel means is affixed to the lower carriage means through the slot in the first channel means. An upper and lower coupling means are affixed to the upper and lower mounting plates respectively, for releasably coupling the upper and lower carriage means to the floating dock structure irrespective of variations in the vertical position of the floating dock structure due to variations in water level and for simultaneously maintaining the floating dock structure parallel to the surface of the body of water. Preferably, the upper and lower coupling means are coupled to an upper surface and lower surface of the floating dock structure, respectively. The upper and lower coupling means may comprises SAE trailer coupler and trailer balls.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 14 is an end view of the first embodiment of the present invention illustrating the relative instability of the floating dock when loaded with the weight of one person or the like; and FIG. 15 is an end view of a third embodiment of the present invention illustrating the stability of the floating dock when loaded with the weight of one person or the like.

Similar reference characters refer to similar parts throughout the several Figures of the drawings.

DETAILED DISCUSSION

Figure 1:
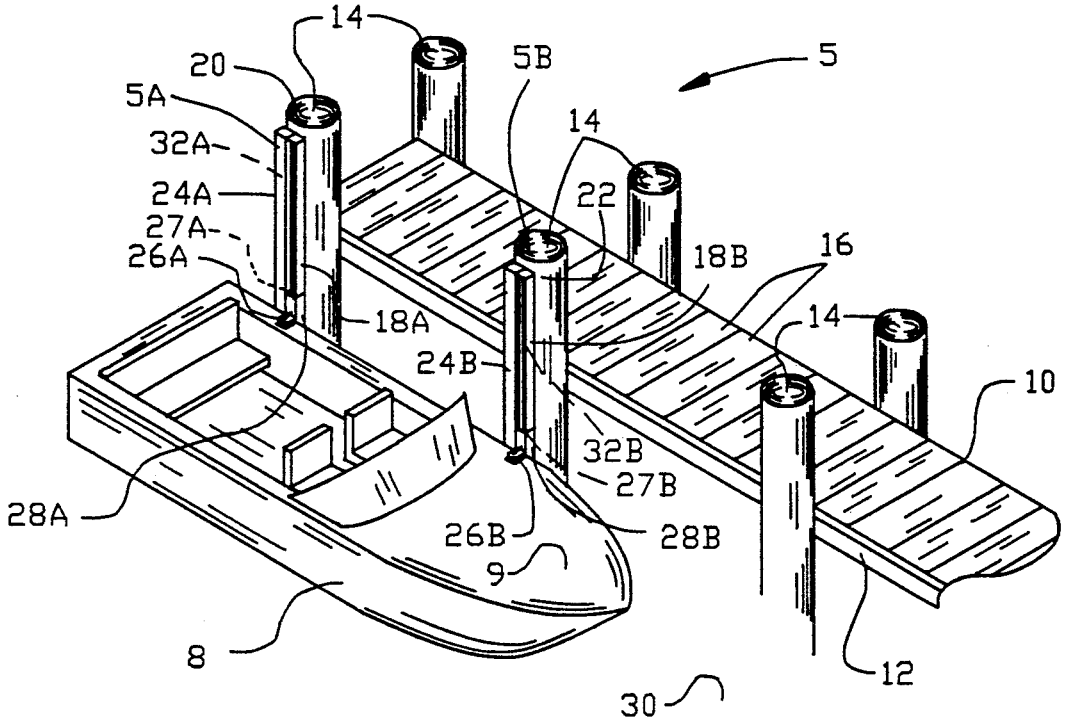
FIG. 1 is an isometric view of a first embodiment of the present invention, wherein the invention is illustrated as a docking system for a small craft.
Figure 2:
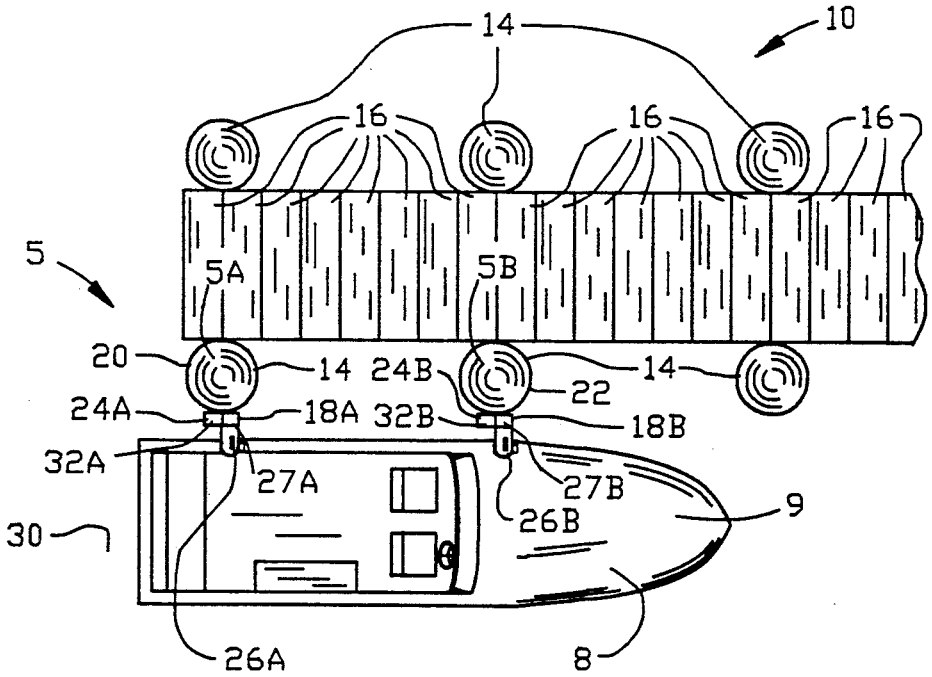
FIG. 2 is a plan view of a first embodiment of the present invention as illustrated in FIG. 1.

FIGS. 1-4 illustrate a first embodiment of an improved water level compensating device shown as a docking system 5 of the present invention comprising identical docking elements 5A and 5B for a small craft 8 having a deck 9. A fixed dock 10 is constructed from a plurality of joists 12 fixed to a plurality of pilings 14 and cross members (not shown). A plurality of decking members 16 are fixed to the joists 12. The pilings 14, joists 12, cross members (not shown) and decking members 16, may be wooden, metallic, synthetic materials, or combinations thereof. The pilings 14 are generally driven into the bottom 17 shown in FIGS. 3 and 4.

The docking elements 5A and 5B comprise first channel means 18A and 18B mounted in substantially vertical positions on boards 19 connected to the pilings 20 and 22. Second channel means 24A and 24B are mounted adjacent and parallel to the first channel means 18A and 18B respectively, in substantially vertical positions on the boards 19 and the pilings 20 and 22. Coupling means 26A and 26B are affixed to carriage means 27A and 27B through mounting plates 28A and 28B, respectively. The carriage means 27A and 27B are movably retained within the first channel means 18A and 18B, respectively, for releasably coupling the small craft 8 to the fixed dock 10. Counterweights 32A and 32B. are movably retained within second channel means 24A and 24B respectively.

As the water level 30 increases or decreases in height relative to fixed dock 10, the small craft 8 rises or falls in accordance with vertical changes in water level 30. The movement of the carriage means 27A and 27B within the first channel means 18A and 18B, compensates for the increases or decreases in the height of the small craft 8 caused by the vertical changes in water level 30. The counterweights 32A and 32B balance and prevent uncontrolled downward motion of the carriage means 27A and 27B, and the coupling means 26A and 26B when the coupling means 26A and 26B is released from small craft 8.

Figure 3:
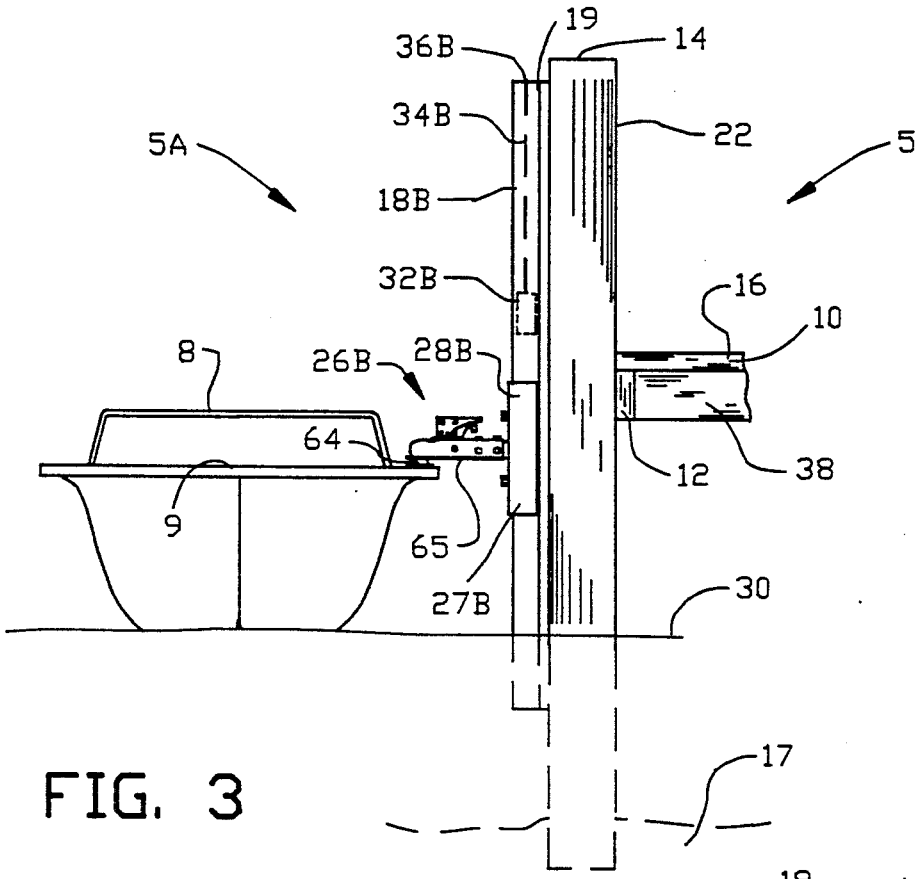
FIG. 3 is a side view of the first embodiment of the present invention illustrating a small craft with a high water level.
Figure 4:
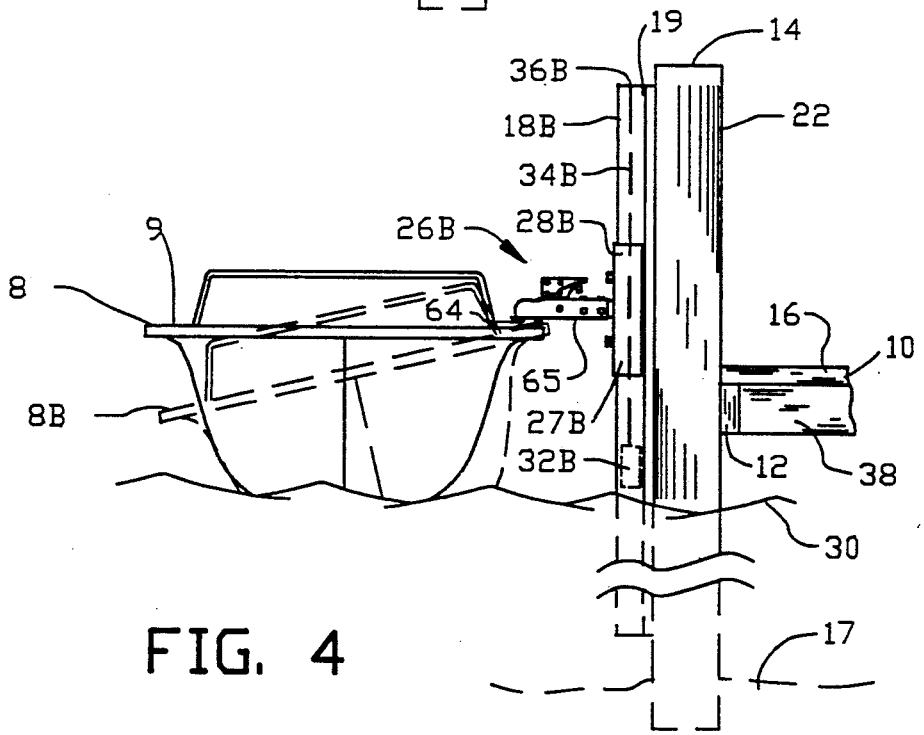
FIG. 4 is a side view of the first embodiment of the present invention illustrating a small craft with a low water level, and further illustrating an extreme of small craft position.
Figure 5:
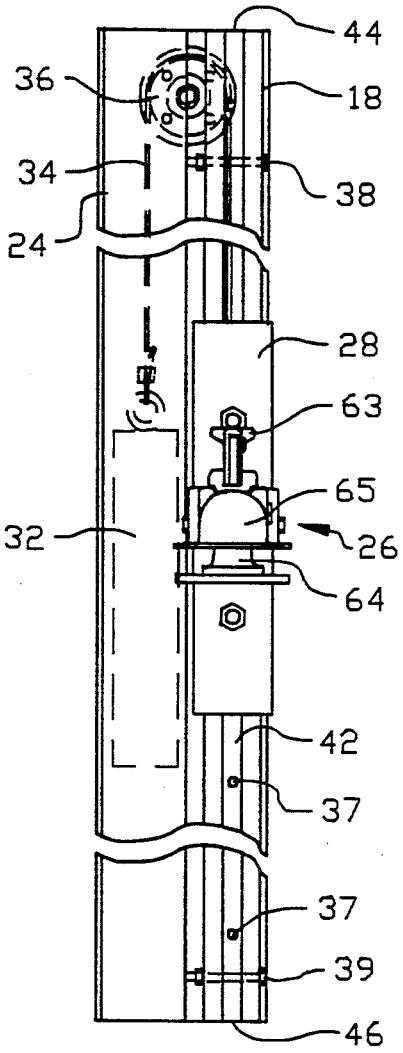
FIG. 5 is a front view of an embodiment of the present invention.
Figure 7:
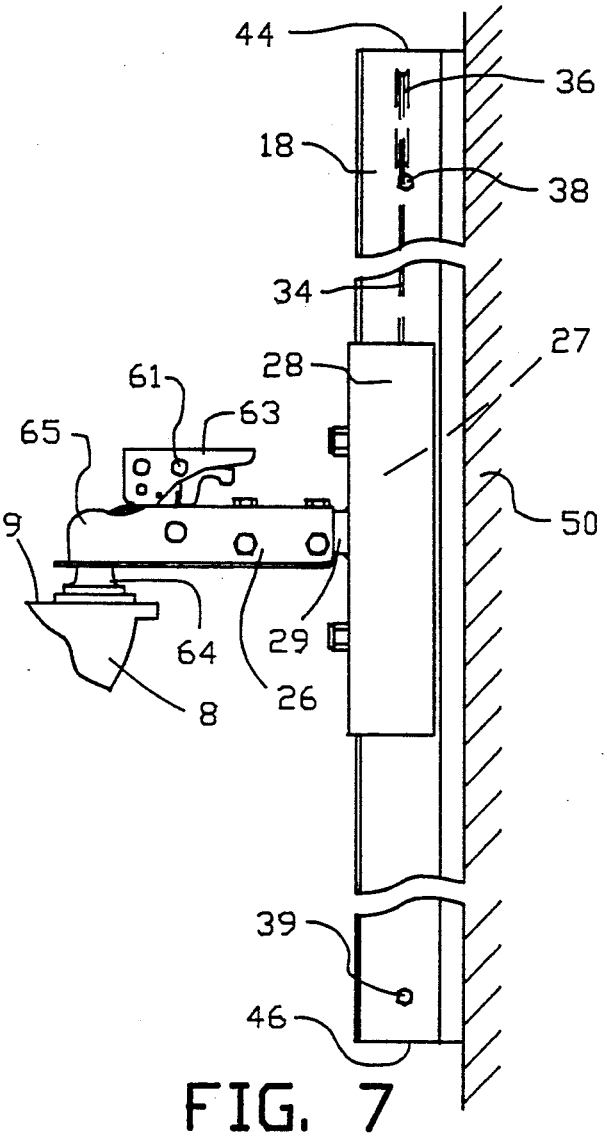
FIG. 7 is a side view of an embodiment of the present invention.
Figure 6:
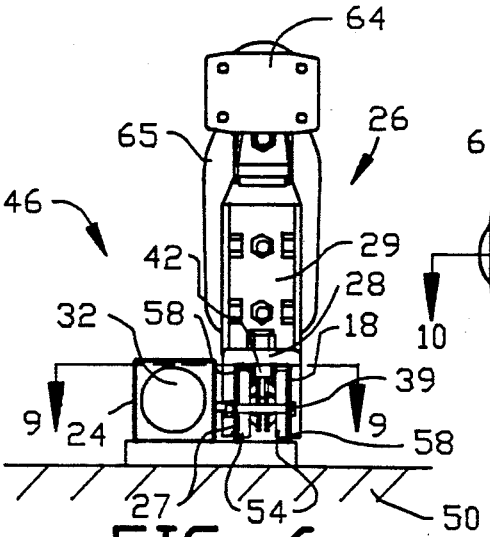
FIG. 6 is a bottom view of an embodiment of the present invention as illustrated in FIG. 5.
Figure 8:
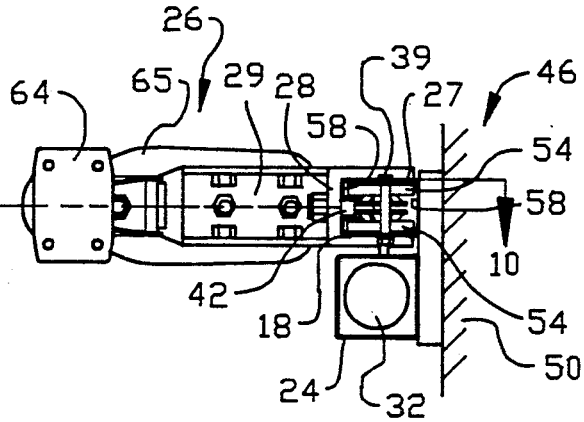
FIG. 8 is a bottom view of an embodiment of the present invention as illustrated in FIG. 7.

FIG. 3 illustrates a low water level relative to fixed dock 10 causing the small craft 8 to lower in accordance with vertical decrease in the water level 30. FIG. 4 illustrates a high water level relative to fixed dock 10 causing the small craft 8 to rise in accordance with vertical increase in the water level 30. FIG. 3 also illustrates the normal position of the small craft 8 in calm conditions of the water surface 30. FIG. 4 illustrates an extreme position of the small craft 8B is shown in phantom in rough conditions of the water surface 30. The extreme position of the small craft 8B as shown in phantom may be produced by extremes of wind and/or wave motion.

FIGS. 5-8 illustrates in greater detail the docking element of the first embodiment of the present invention. The first channel means 18 is affixed by affixing means 37 such as screws or bolts (not shown) to a fixed land mass 50 such as a seawall, a piling or the like. An upper carriage stop 38 and lower carriage stop 39 limit the vertical travel of carriage means 27. A slot 42 extends from a top end 44 to a bottom end 46 of the first channel 18. The coupling means 26 shown as a SAE class 1 trailer coupler 65, or the like is affixed by bolts to an arm 29 extending from the mounting plate 28. The SAE class 1 trailer ball 64, is affixed to a floating object such the deck 9 of the vessel 8. A locking means, such as a padlock (not shown) may be placed through padlock aperture 61 of coupler release lever 63 of trailer coupler 65, to prevent unauthorized removal of the floating object 52 from fixed land mass 50. The mounting plate 28 is affixed to the carriage means 27 through slot 42 in first channel means 18 as will be described in greater detail with reference to FIGS. 9 and 10.

The second channel means 24 is affixed to the fixed land mass 50 adjacent to first channel means 18. The first channel means 18 is shown contacting and parallel to the second channel means 24. The counterweight 32 is movably retained within second channel means 24. A first end of a flexible cable 34 is affixed to counterweight 32 and is journalled by pulley 36 rotatably mounted proximate the top end 44 of first channel means 18 and second channel means 24. A second end of the flexible cable 34 is affixed to the carriage means 27 movably retained within first channel means 18. The counterweight 32 balances and prevents uncontrolled downward motion of carriage means 27 and coupling means 26 when released from floating object 52.

Figure 9:
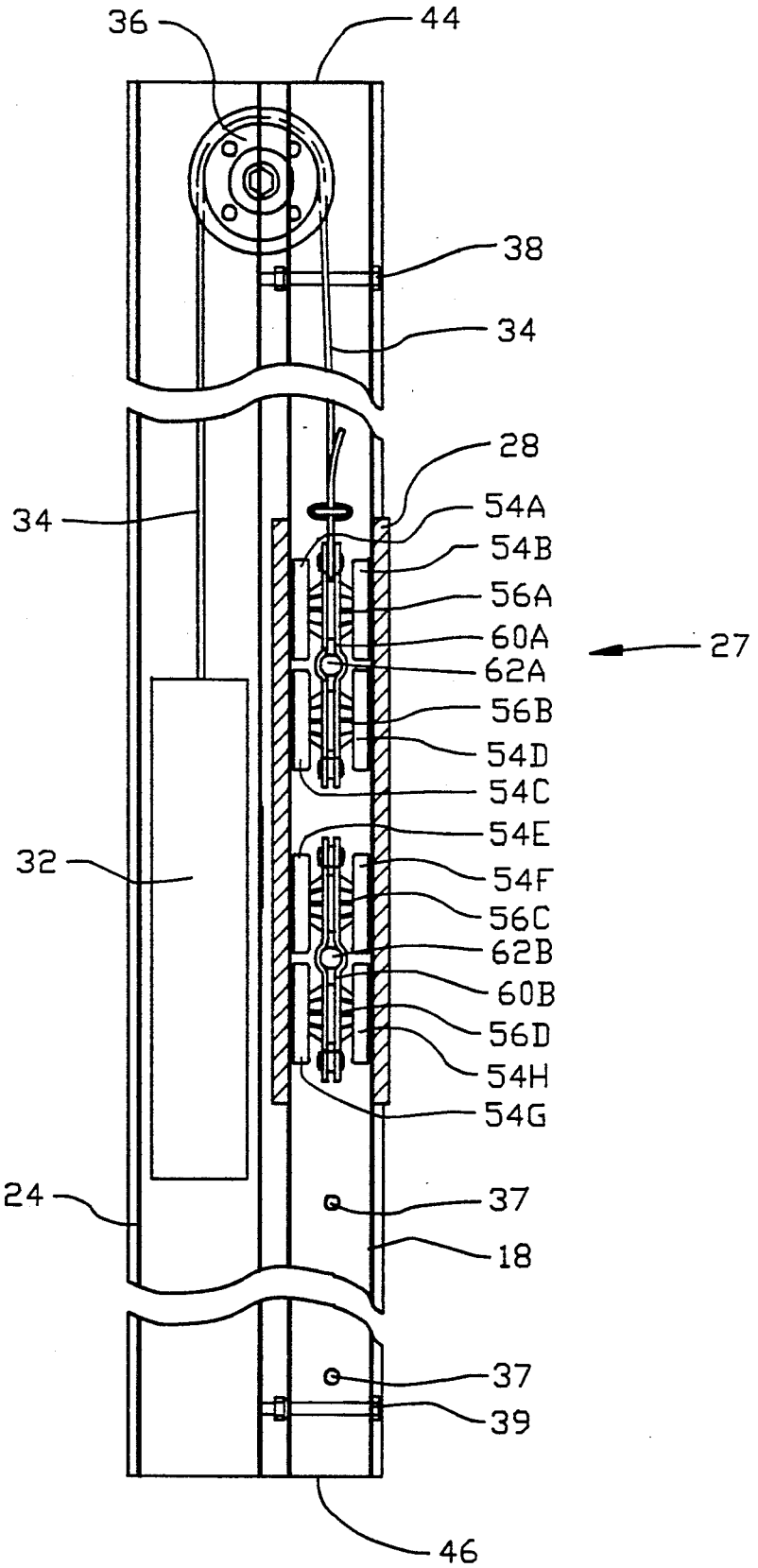
FIG. 9 is a sectional view along line 9—9 of FIG. 6.
Figure 10:
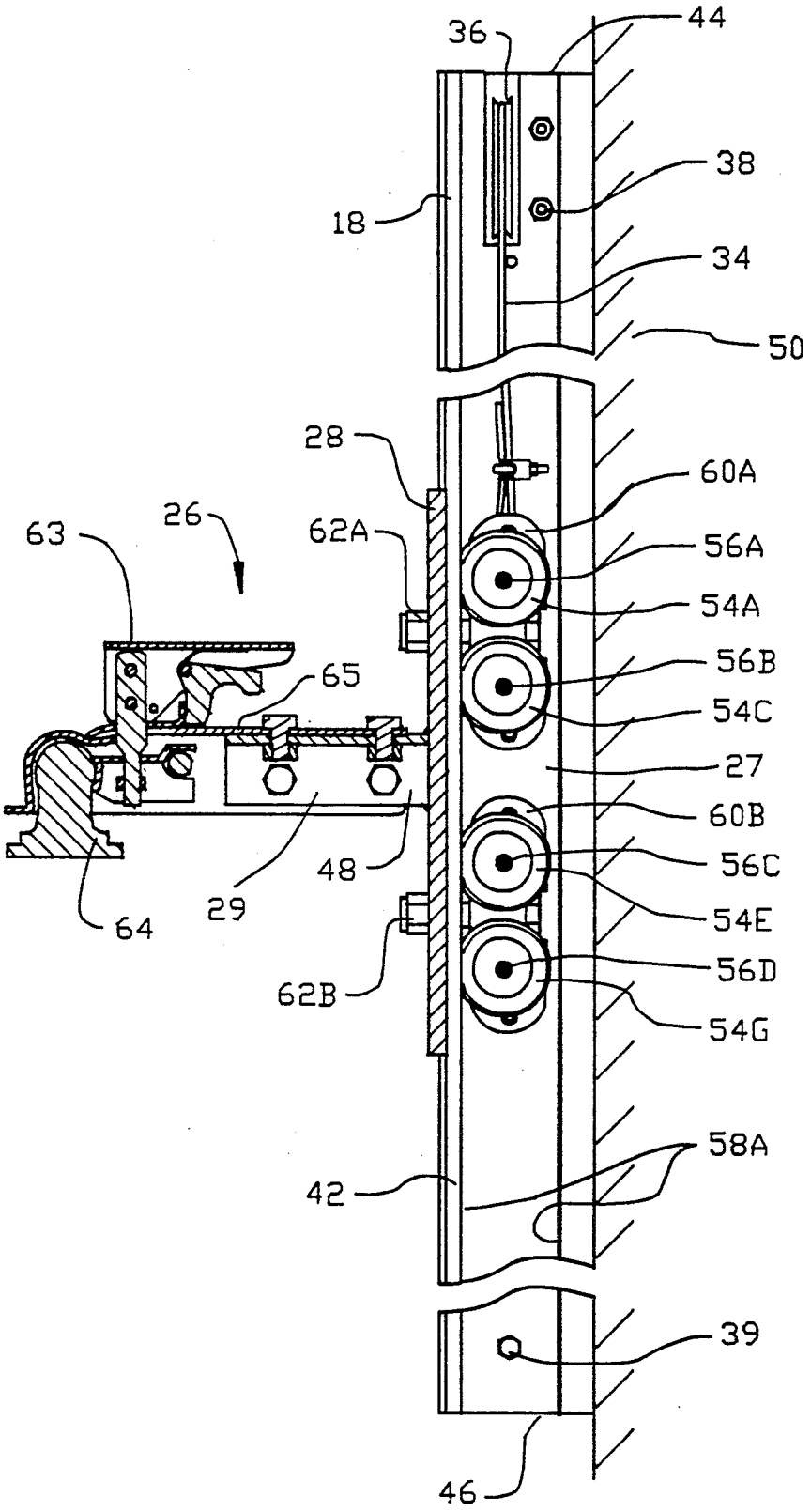
FIG. 10 is a sectional view along line 10—10 of FIG. 8.

FIGS. 9 and 10 further illustrate the carriage means 27 within first channel means 18. Movement of the carriage means 27 is provided by action of a plurality of wheels 54A-54H mounted on a plurality of axles 56A-56D. The plurality of wheels 54A-54H rotatably act on an interior wall 58 of first channel means 18. The plurality of wheels 54A and 54B are mounted on axle 56A whereas the plurality of wheels 54C and 54D are mounted on axle 56B. The axles 56A and 56B are secured to and are retained by a longitudinal member 60A. A mounting stud 62A extends through the longitudinal member 60A, through the slot 42 of the first channel means 18 and is affixed to the mounting plate 28. The plurality of wheels 54E and 54F are mounted on axle 56C whereas the plurality of wheels 54G and 54H are mounted on axle 56D. The axles 56C and 56D are secured to and are retained by a longitudinal member 60B. A mounting stud 62B extends through the longitudinal member 60B, through the slot 42 of the first channel means 18 and is affixed to the mounting plate 28. Adjustment of the plurality of axles 56A-56D acting on the interior wall 58 may be made through the adjustment of studs 62A and 62B.

Vertical movement of carriage means 27 within first channel means 18 is provided by action of the assemblies of a plurality of wheels 54A-54G and axles 56A-56D rotatably acting on the interior wall 58 and of first channel means 18. The first channel means 18 may take the form of a conventional garage door or barn door track with the carriage means 27 including the plurality of wheels 54A-54G and axles 56A-56D being the carriage means connected to the garage door or barn door.

Figure 11:
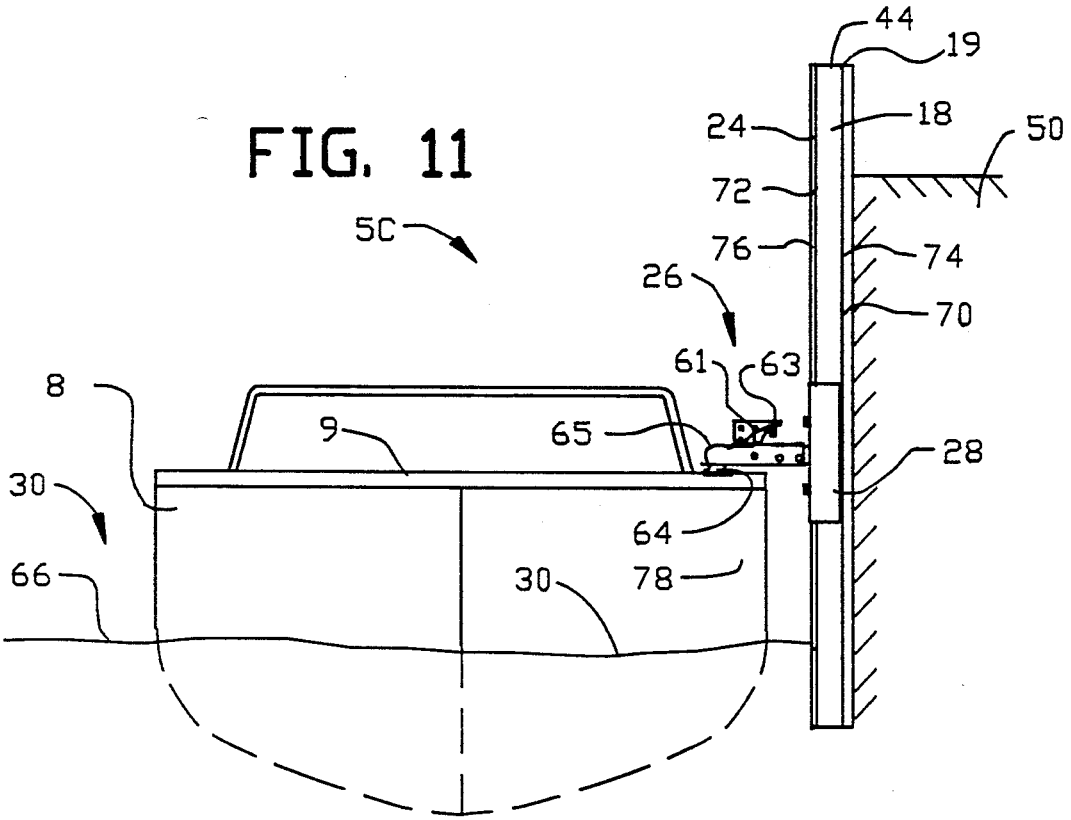
FIG. 11 is an end view of a small craft docked using a second embodiment of the present invention, wherein the small craft is subjected to minimal wind and/or wave motion.

FIG. 11 is an end view of the small craft 8 docked using the second embodiment 5C of the present invention, wherein the small craft 8 is subjected to minimal wind and/or wave motion 66. The first channel means 18 is shown as a substantially rectangular tubular member having a back surface 70, and a front surface 72, with back surface 70 being affixed to the fixed land mass 50 through the board 19. The second channel means 24 is shown as a tubular member constructed from a flexible and resilient material having a back surface 74, and a front surface 76. In this second embodiment, the front surface 76 of the second channel means 24 extends outwardly from the fixed land mass 50 a substantially greater distance than the front surface 72 of the first channel means 18.

Figure 12:
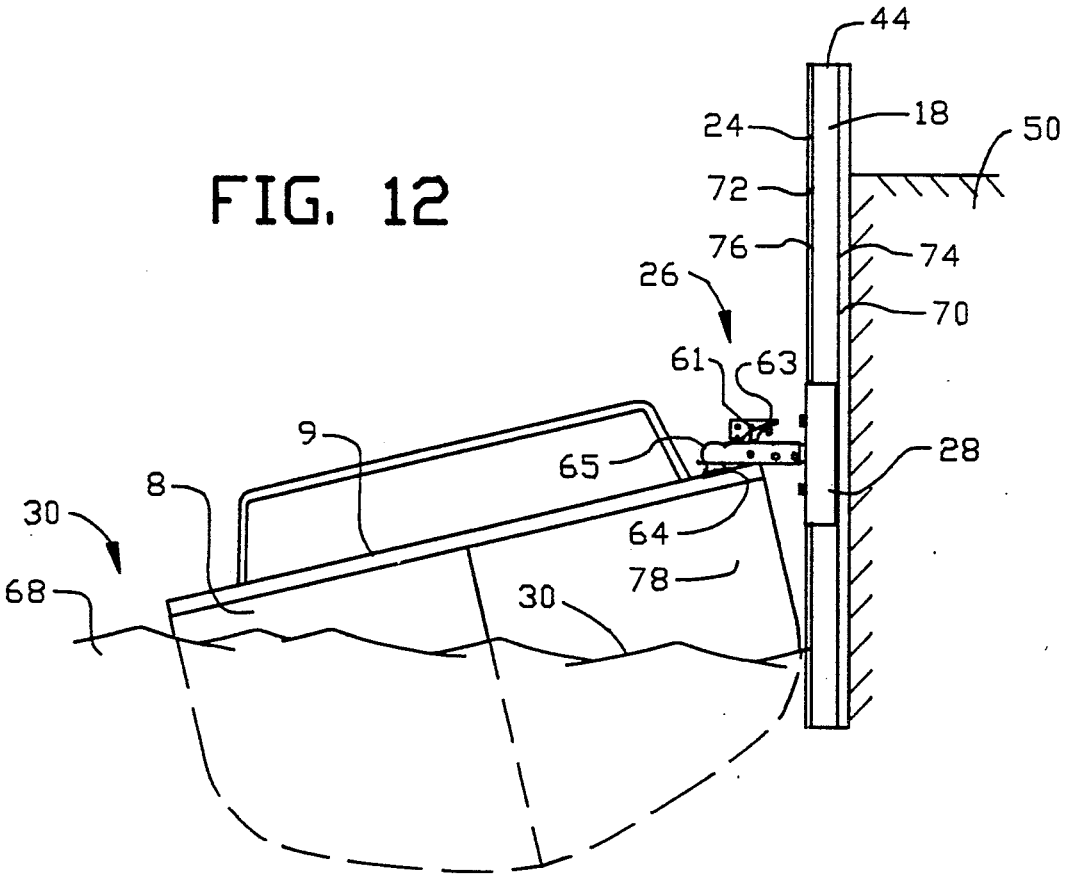
FIG. 12 is an end view of a small craft docked using the second embodiment of the present invention, wherein the small craft is subjected to extreme wave motion and contacts the fender means of the present invention.

FIG. 12 is an end view of the small craft 8 docked using the second embodiment of the present invention, wherein the small craft 8 is subjected to extreme wave motion. Since the front surface 76 of the second channel means 24 extends outwardly a substantially greater distance than the front surface 72 of the first channel means 18, the second channel means 24 acts as a fender means for nondestructively absorbing impact of the small craft 8. The large wave action 68 on water level 30 attempts to produce horizontal motion of the small craft 8. The forces acting to produce the horizontal motion are translated into rotational motion about an axis at the coupler ball 64 of the small craft 8. FIG. 12 further illustrates the effects of the rotational motion of the small craft 8, wherein the hull 78 of the small craft 8 contacts the front surface 76 of the second channel means 24. The flexible and resilient material utilized in construction enables the second channel means 24 to act as a fender means for nondestructively absorbing impact of the small craft 8 and prevents contact with first channel means 18. Preferably the second channel means 24 is PVC pipe to provide a flexible and resilient material to act as a fender means.

Figure 13:
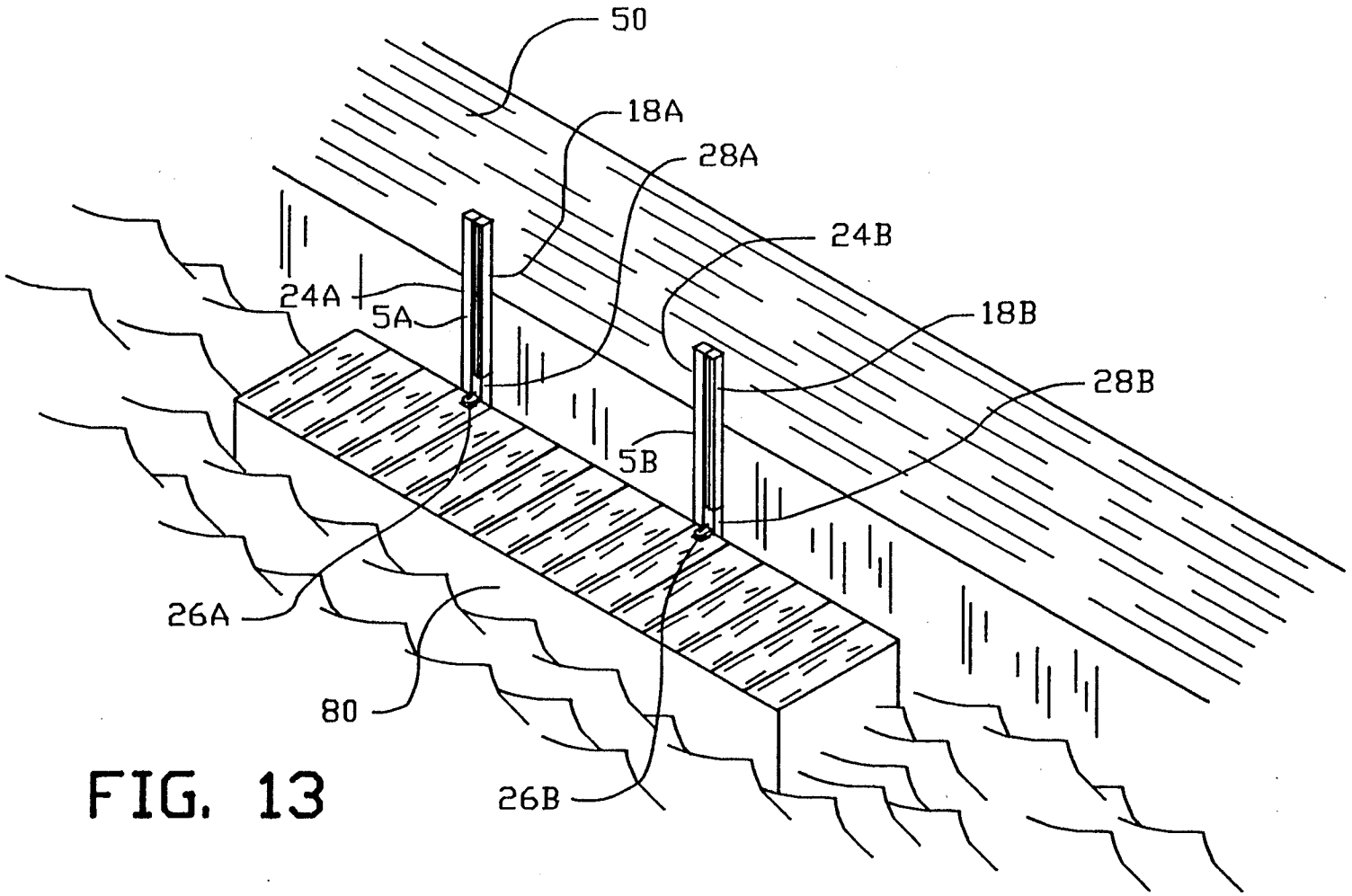
FIG. 13 is a pictorial view of the first embodiment of the present invention, wherein the invention is illustrated as a water level compensation system for a floating dock.

FIG. 13 illustrates the first embodiment of the present invention, wherein the invention is illustrated as a water level compensation system for a floating dock 80. First channel means 18A and 18B are affixed to the fixed land mass 50 in a substantially vertical orientation. Similarly, the second channel means 24A and 24B are affixed to fixed land mass 50 in a substantially vertical position. Coupling means 26A and 26B are affixed through mounting plates 28A and 28B to carriage means movably retained within the first channel means 18A and 18B as heretofore described. As water level 30 increases or decreases in height relative to fixed land mass 50, the floating dock 80 rises or falls in accordance with vertical changes in water level 30, by action of vertical movement of the carriage means movably retained within first channel means 18A and 18B as previously described.

Figure 14:
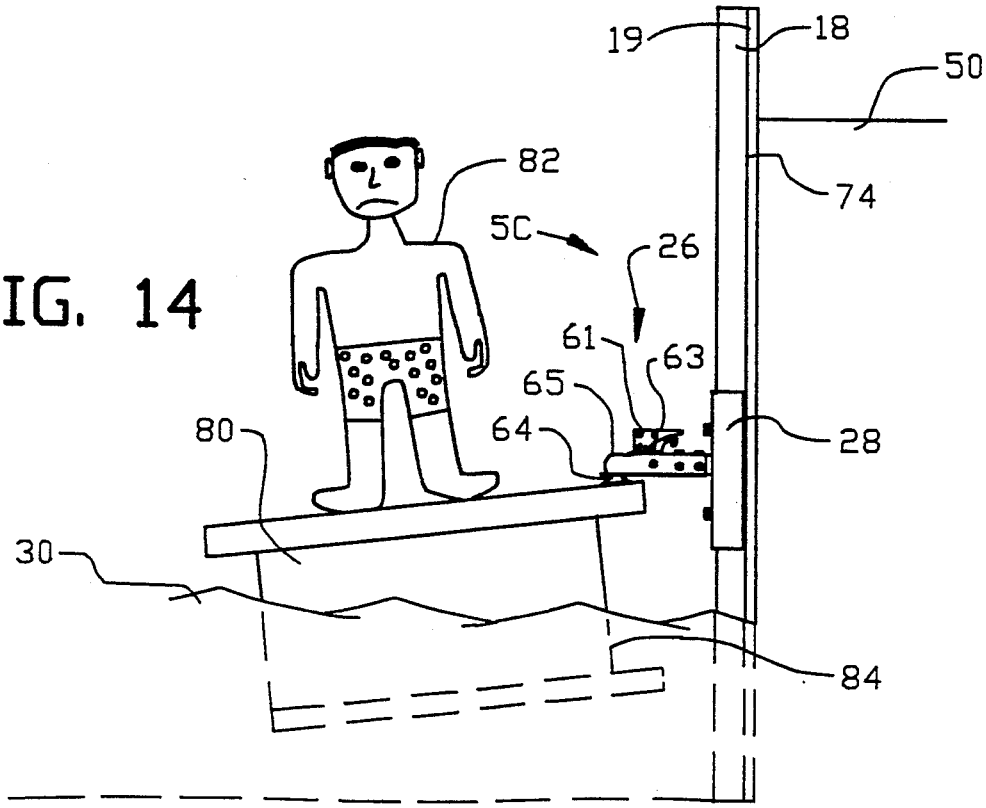

FIG. 14 is an end view of the first embodiment of the present invention illustrating the relative instability of the floating dock 80 when loaded with the uncentered weight of one person 82 or the like. Narrow floating docks 80 become unstable as uncentered weight of a person 82 or the like are applied as illustrated in FIG. 14. The forces acting to produce this instability are translated into rotational motion about an axis at coupler ball 64 of floating dock 80. FIG. 14 further illustrates the effects of the rotational motion of floating dock 80, wherein the sides 84 of floating dock 80 may contact the second channel means 24. The rotational action decreases the stability of floating dock 80 and may cause the inadvertent and accidental expulsion of the person 82 or the like from the floating dock 80.

Figure 15:
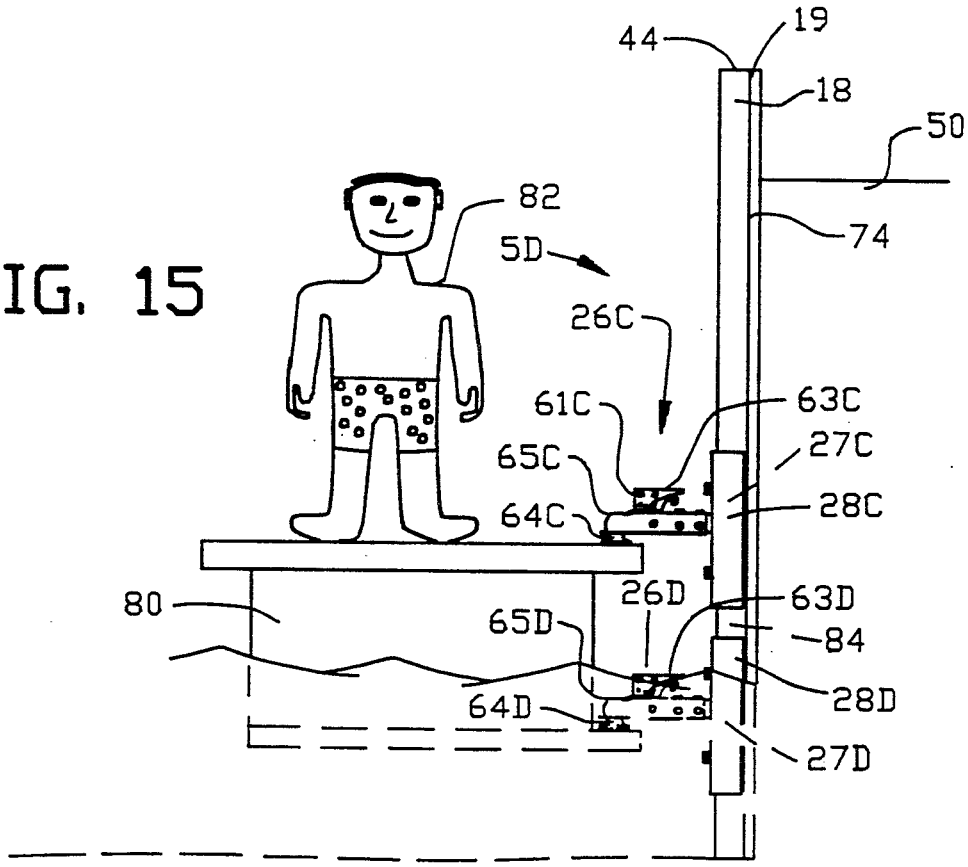

FIG. 15 is an end view of a third embodiment 5D of the present invention illustrating the stability of the floating dock 80 when loaded with the uncentered weight of one person 82 or the like. First channel means 18 is affixed to fixed land mass 50 in a substantially vertical position through a board 19. A second channel means (now shown) is affixed, in a substantially vertical position, to fixed land mass 50 and adjacent to first channel means 18 in a manner similar to the second channel means 24A and 24B shown in FIG. 1. An upper coupling means 26C comprises SAE class 1 trailer coupler 65C, or the like, affixed to mounting plate 28C, and SAE class 1 trailer ball 64C, or the like, affixed to floating dock 80. Upper mounting plate 28C is affixed to upper carriage means 27C, movably retained within first channel means 18, for releasably coupling an upper portion of the floating dock 80 to fixed land mass 50. In this embodiment, the invention comprises a lower coupling means 26D having a SAE class 1 trailer coupler 65D, or the like, affixed to the lower mounting plate 28D, and a SAE class 1 trailer ball 64D, or the like, affixed to floating dock 80. Lower mounting plate 28D is affixed to an lower carriage means 27D, movably retained within first channel means 18 and below upper carriage means 27C, for releasably coupling a lower portion of the floating dock 80 to fixed land mass 50. Preferably, the upper carriage means 27C and the lower carriage means 27D are identical to the carriage means 27 shown in FIGS. 5–10. A counterweight is movably retained within the second channel means and is journalled by a pulley rotatably mounted proximate the top end 44 of first channel means 18 and second channel means 24 as previously described. A carriage connecting means is provided to interconnect upper carriage means 27C and lower carriage means 27D enabling upper carriage means 27C and lower carriage means 27D to move in unison.

As water level 30 increases or decreases in height relative to fixed land mass 50, floating dock 80 rises or falls in accordance with vertical changes in water level 30, by action of vertical movement of carriage means 27C and 27D movably retained within first channel means 18.

The tendency of narrow floating docks 80 to become unstable from an uncentered weight of a person 82 or the like is eliminated in this embodiment of the present invention. The forces acting to produce this instability which would normally be translated into rotational motion about an axis at the upper coupler ball 64C of the floating dock 80. Since the carriage connecting means interconnects the upper carriage means 27C and the lower carriage means 27D, the rotational motion about an axis at the upper coupler ball 64C of the floating dock 80 is prevented by the inclusion of the lower coupler means 26D affixed to a lower portion of the floating dock 80.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved water level compensation device for adjusting the vertical position of a floating object relative to a fixed land mass, comprising:

first channel means having a top end and a bottom end with a slot extending proximate said top end to said bottom end;

means for attaching said first channel means to the fixed land mass in a substantially vertical position;

a carriage means movably retained within said first channel means for bidirectional movement in a substantially vertical direction between said top end to said bottom end of said first channel means;

a mounting plate disposed external to said first channel means and affixed to said carriage means through said slot in said first channel means;

second channel means having a top end and a bottom end;

means for attaching said second channel means to the fixed land mass in a substantially vertical position;

a counterweight movably retained within said second channel means for bidirectional movement in a substantially vertical direction between said top end and said bottom end of said second channel means;

a flexible cable having a first end affixed to said carriage means and a second end affixed to said counterweight;

a pulley rotatably mounted proximate said top end of said first and second channel means for journalling said cable to enable said counterweight to balance the weight of said carriage means and said mounting plate; and coupling means affixed to said mounting plate for releasably coupling said carriage means to the floating object for securing the floating object relative to the fixed land mass irrespective of variations in the vertical position of the floating object due to variations in water level.

2. An improved water level compensation device as set forth in claim 1, wherein said coupling means comprises a SAE trailer coupler and a trailer ball;

said SAE trailer coupler being affixed to said carriage means; and said trailer ball being affixed to the floating object for providing a rapidly releasable coupling between the floating object and the fixed land mass.

3. An improved water level compensation device as set forth in claim 1, wherein said coupling means comprises a SAE trailer coupler and a trailer ball;

said SAE trailer coupler being affixed to said carriage means;

said trailer ball being affixed to the floating object for providing a rapidly releasable coupling between the floating object and the fixed land mass; and locking means for locking said SAE trailer coupler to said trailer ball affixed to the floating object.

4. An improved water level compensation device as set forth in claim 1, wherein said first channel means comprises a substantially rectangular tubular member having a back surface, a front surface, a first side, and a second side, and said slot disposed in said front surface of said substantially rectangular tubular member.

5. An improved water level compensation device as set forth in claim 1, wherein said first channel means comprises a substantially rectangular tubular member having a back surface, a front surface, a first side, and a second side, and said second channel means comprises a tubular member constructed from a flexible and resilient material having a back surface and a front surface;

said front surface of said second channel means extending outwardly from the fixed land mass a substantially greater distance than said front surface of said first channel means enabling said second channel means to act as a fender means for nondestructively absorbing impact of the floating object.

6. An improved water level compensation device as set forth in claim 1, wherein the floating object comprises a small craft.

7. An improved water level compensation device as set forth in claim 1, wherein said means for attaching said first channel means to the fixed land mass includes attaching said first channel means to a fixed dock.

8. An improved water level compensation device as set forth in claim 1, wherein said carriage means includes a plurality of wheels secured to said carriage means for engaging a back surface and a front surface of said first channel means to retain said carriage means within said first channel means and for enabling said bidirectional movement within said first channel means.

9. An improved water level compensation device as set forth in claim 1, wherein said carriage means includes a first axle secured to a first end of said carriage means and a second axle secured to a second end of said carriage means; and a first and second plurality of wheels secured to said first and second axles for engaging a back surface and a front surface of said first channel means to retain said carriage means within said first channel means and for enabling said bidirectional movement within said first channel means.

10. An improved water level compensation device as set forth in claim 1, including a coupling plate for connecting said mounting plate external said first channel means to said carriage means through said slot in said first channel means.

11. An improved water level compensation device for adjusting the vertical position of a floating dock structure relative to a fixed land mass, comprising:

first channel means having a top end and a bottom end with a slot extending proximate said top end to said bottom end;

means for attaching said first channel means to the fixed land mass in a substantially vertical position;

an upper carriage means movably retained within said first channel means for bidirectional movement in a substantially vertical direction within said first channel means;

a lower carriage means movably retained within said first channel means for bidirectional movement in a substantially vertical direction within said first channel means;

an upper mounting plate disposed external to said first channel means and affixed to said upper carriage means through said slot in said first channel means;

a lower mounting plate disposed external to said first channel means and affixed to said lower carriage means through said slot in said first channel means;

second channel means having a top end and a bottom end;

means for attaching said second channel means to the fixed land mass in a substantially vertical position;

a counterweight movably retained within said second channel means for bidirectional movement in a substantially vertical direction between said top end and said bottom end of said second channel means;

a first flexible cable having a first end affixed to said upper carriage means and a second end affixed to said counterweight;

a pulley rotatably mounted proximate said top end of said first and second channel means for journalling said second flexible cable to enable said counterweight to balance the weight of said upper and lower carriage means and said first and second mounting plates; and an upper and a lower coupling means affixed to said upper and lower mounting plates for releasably coupling said upper and lower carriage means to the floating dock structure irrespective of variations in the vertical position of the floating dock structure due to variations in water level and for simultaneously maintaining the floating dock structure parallel to the surface of the body of water.

12. An improved water level compensation device as set forth in claim 11, wherein said upper and lower coupling means are coupled to an upper surface and a lower surface of the floating dock structure, respectively.

13. An improved water level compensation device as set forth in claim 11, wherein each of said upper and lower coupling means comprises an upper and a lower SAE trailer coupler and an upper and a lower trailer ball;

said upper and lower SAE trailer couplers being affixed to said first and second carriage means; and said upper and lower trailer balls being affixed to an upper and a lower portion of the floating dock structure for providing a rapidly releasable coupling between the floating dock structure and the fixed land mass.

* * * * *